US006874252B2

(12) United States Patent
Nakano

(10) Patent No.: US 6,874,252 B2
(45) Date of Patent: Apr. 5, 2005

(54) SELF DRAINING SHOE

(75) Inventor: Kiyotaka Nakano, Rockford, MI (US)

(73) Assignee: Wolverine World Wide, Inc., Rockford, MI (US)

( * ) Notice: Subject to any disclaimer, the term of this patent is extended or adjusted under 35 U.S.C. 154(b) by 0 days.

(21) Appl. No.: 10/761,740

(22) Filed: Jan. 21, 2004

(65) Prior Publication Data

US 2004/0148800 A1 Aug. 5, 2004

Related U.S. Application Data

(62) Division of application No. 10/047,576, filed on Jan. 14, 2002, now Pat. No. 6,701,640.

(51) Int. Cl.[7] ..... A43B 5/08; A43B 7/08

(52) U.S. Cl. ..... 36/8.1; 36/3 B; 36/3 R; 36/3 A; 36/50.1

(58) Field of Search ..... 36/3 B, 3 R, 3 A, 36/8.1

(56) References Cited

U.S. PATENT DOCUMENTS 250,539 A * 12/1881 Hoover ..... 36/3 R
588,768 A * 8/1897 Kennedy ..... 36/3 B
616,112 A * 12/1898 Kennedy ..... 36/3 R
863,873 A * 8/1907 Pratt ..... 36/37
2,239,211 A * 4/1941 Wylie ..... 36/3 B
2,334,719 A * 11/1943 Margolin ..... 36/3 B
4,438,573 A * 3/1984 McBarron ..... 36/3 B
4,525,940 A * 7/1985 Mochizuki ..... 36/8.1
4,617,745 A 10/1986 Batra
4,679,335 A * 7/1987 Berlese ..... 36/131
4,910,887 A 3/1990 Turner et al.
4,912,858 A * 4/1990 Mochizuki ..... 36/3 B
4,939,851 A 7/1990 Miller

* cited by examiner

*Primary Examiner*—Ted Kavanaugh
(74) *Attorney, Agent, or Firm*—Warner Norcross & Judd LLP

(57) ABSTRACT

An article of footwear having an upper, an outsole, and a midsole. The midsole defines a plurality of upper and lower channels intersecting in a waffled construction to define openings. The channels and openings allow passage of water from the interior of the article of footwear. The upper channels extend across the upper half of the midsole in one direction and the lower channels extend across the bottom half of the midsole in another direction. The channels are of sufficient depth so that the upper and lower channels intersect one another to define the openings through which the water may pass from the upper channels to the lower channels. The outsole forms the wear surface and covers a majority of the undersurface of the midsole, preferably defining a plurality of outlets or ports through which water may drain from the bottom of the shoe.

20 Claims, 5 Drawing Sheets

SELF DRAINING SHOE

This is a division of application Ser. No. 10/047,576, filed Jan. 14, 2002 (now U.S. Pat. No. 6,701,640).

BACKGROUND OF THE INVENTION

The present invention relates to footwear constructions and more particularly to footwear for outdoor use.

Outdoor shoes and boots must provide comfort and stability for the wearer while being exposed to a variety of conditions. To provide comfort, footwear must keep the wearer's foot as dry as possible. Conventional outdoor footwear can become rapidly water saturated from stepping into water or rain, thereby making the shoe or boot wet and uncomfortable. A water-saturated shoe may reduce the wearability causing discomfort, blisters, and bacteria growth.

Some manufacturers have waterproofed shoes and boots to prevent water from entering. This approach works well until the wearer steps into water above the lip of the shoe, allowing the water to pour into the shoe. Water may also enter these waterproof shoes by water running down the wearer's leg into the shoe. Once water enters a waterproof shoe, the shoe works against the wearer by preventing water from exiting the shoe, thereby increasing the discomfort. Further, once the wearer's sock and inner portions of the shoe are wet, a waterproof shoe may take extra time to dry due to the limited moisture transfer and breathability of waterproof shoes.

One manufacturer has addressed this problem as shown in U.S. Pat. No. 4,910,887 to Turner et al. Turner discloses a shoe having an upper unit, a midsole, and an outsole. The upper unit includes a hydrophobic inner lining to remove water within the shoe to the exterior of the shoe. The shoe also includes a bottom mesh with an open configuration situated over the midsole to allow water to drain into somewhat rectangular depressed portions (cavities) in the midsole. Unfortunately, the open structure of these cavities may not provide sufficient support for the wearer's foot while walking, running or for general outdoor use. The cavities include ramps that direct the water flow out of the outlet channels. Although the ramps may provide some support for the wearer's foot, they can cause pressure points while walking. These problems are heightened by the fact that the cavities are located under the ball and heel of the foot, where the most pressure is applied on the foot during walking. Further, the cavities only being under the ball and forefoot of the shoe may limit the exit of the water from the shoe due to the foot covering these cavities during walking. The location, size and number of channels may also limit or prevent water from freely flowing out of the shoe. The channels freely open to the exterior may become clogged with dirt or sand, preventing the free flow of water out of the shoe.

SUMMARY OF THE INVENTION

The aforementioned problems are overcome by the present invention wherein an article of footwear is provided with a waffled midsole having intersecting channels that allow passage of water from the interior of the article of footwear. The midsole includes a plurality of channels extending across the upper half of the midsole in one direction and a second plurality of channels extending across the bottom half of the midsole in another direction. The channels are of sufficient depth so that the upper and lower channels intersect one another to define openings through which the water may pass from the upper side of the midsole to the lower side of the midsole.

In a preferred embodiment, the article of footwear also includes an upper having mesh-like portions that permit the passage of water and facilitate quick drying. The mesh-like portions of the upper preferably extend down along the peripheral edge of the midsole to cover the open ends of the midsole channels.

In another preferred embodiment, the article of footwear includes an outsole forming a wear surface. The outsole covers a majority of the undersurface of the midsole, preferably defining a plurality of outlets or ports through which water may drain from the bottom of the shoe. The outsole wraps upwardly preferably around only portions of the midsole, thereby permitting water to drain from the open ends of at least some of the midsole channels. The outsole preferably leaves some channels open on each side of the midsole so that the water may drain regardless of the angle or tilt of the shoe.

In a more preferred embodiment, the article of footwear includes a modified Strobel construction. The upper includes a peripheral marginal portion that wraps beneath and is secured to the undersurface of the midsole. A mesh-like liner is sewn into the upper. The liner includes a top liner that lines the inside of the upper and a bottom liner that extends over the top of the midsole. The bottom liner is Strobel stitched to the top liner. The article of footwear may also include a footbed that is fitted into the upper above the bottom liner. The footbed preferably defines holes through which the water may pass into the channels.

The present invention provides a stable, comfortable, and quick-drying shoe having channels that allow the passage of water. The channel configuration of the present invention provides a relatively smooth, uniform and stable surface, thereby eliminating the pressure points of the prior art. The dispersed channel configuration also eliminates the need for large cavities, thereby providing consistent and uniform support for the foot. Accordingly, the present invention permits water passage while still maintaining the stability demanded in outdoor footwear. The channels also provide drainage throughout essentially the entire shoe, thereby decreasing the amount of time it may take the water to exit the shoe or boot. Because the mesh-like material covers the open ends of the channels, it prevents certain dirt or debris from clogging the exits. This mesh like material may also slow the rate with which water may enter the shoe if the user steps into water, potentially keeping the foot dry, for example, during a misstep into a puddle.

These and other objects, advantages and features of the invention will be more readily understood and appreciated by reference to the detailed description of the preferred embodiment and the drawings.

DETAILED DESCRIPTION OF THE PREFERRED EMBODIMENTS

Figure 1:
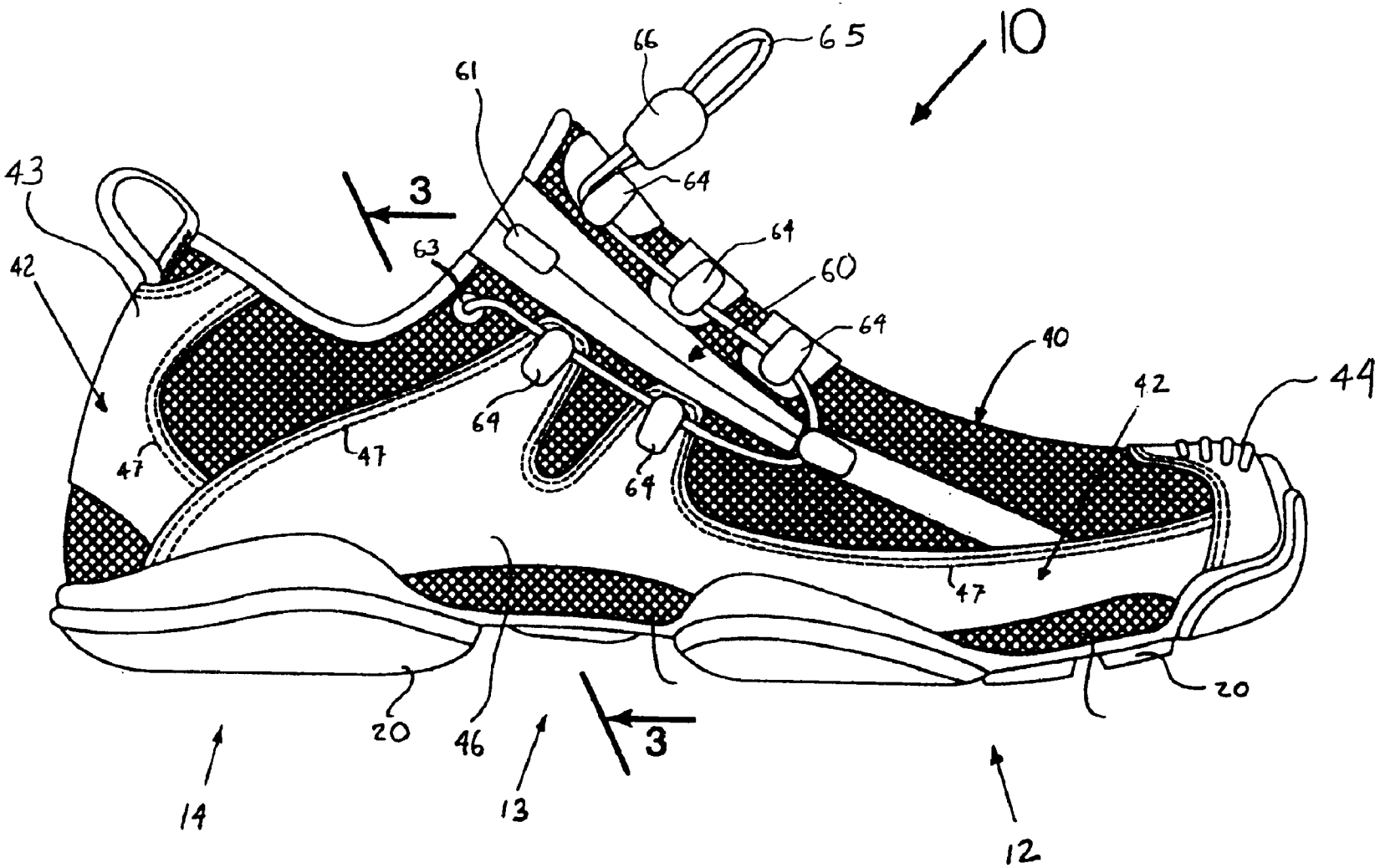
FIG. 1 is a side view of a shoe incorporating the present invention.

A shoe constructed in accordance with the preferred embodiment of the present invention is shown in FIGS. 1 and 2 and generally designated 10. The shoe 10 is constructed to permit water to freely drain from the shoe through the upper and the sole. In general, the shoe 10 includes an outsole 20, a midsole 30, a mesh-like upper 40 and a perforated footbed 70. The midsole 30 includes water drainage channels 50 arranged in a waffle-like configuration. The outsole 20 defines water outlets and is shaped to allow water to drain from the midsole 30. The illustrated shoe 10 is intended to be worn on the left foot and will be described in detail. Of course, a shoe intended to be worn on the right foot is preferably the mirror image of the illustrated shoe 10. The shoe 10 includes a front portion 12, a middle portion 13, a rear portion 14, an inner or medial side 16, and an outer or lateral side 18. By way of further clarification, when worn, the medial side 16 of the illustrated shoe 10 for the left foot will face the medial edge of the shoe for the right foot (not shown). To facilitate disclosure, the term "shoe" is used herein to refer not only to conventional shoes, but also to boots and other types of footwear.

I. Construction

As noted above, the shoe generally includes an upper 40, a footbed 70, a midsole 30, and outsole 20. The upper 40 protects the wearer's foot and keeps the wearer's foot retained within the shoe 10. The footbed 70 provides cushioning for the wearer's foot and is perforated to permit water to drain to the midsole 30. The midsole 30 provides both cushioning and support, and includes waffle-like channels that permit water to drain from the shoe. The outsole 20 provides durability and traction for the shoe 10. The shoe 10 is constructed to allow a balance between support, the passage of moisture and water, and weight.

The upper 40 is generally formed from a combination of reinforcing members 42 and mesh 48. The mesh 48 may be formed from canvas, nylon or other synthetic materials. In the preferred embodiment, the mesh 48 has a somewhat open breathable construction to allow moisture and water to pass through it. In other embodiments, the mesh portions of the upper 40 may alternatively be formed from waterproof or water-resistant materials. In the preferred embodiment, the mesh 48 is a single piece passing from the top of the upper 40 down along the medial and lateral side 16 and 18 and the front portion 12 and rear portion 14 to be attached to the lower surface 33 of the midsole 30. A top liner 74 and a bottom liner 76 may line the inner surface of the mesh 48. The top liner 74 and the bottom liner 76 may be made from the same material as the mesh 48 to allow for breathability and passage of water, although other materials may easily be substituted. A bottom liner 76 is stitched to the top liner 74 with a line of stitching 75. The bottom liner 76 passes over the midsole 30.

Figure 2:
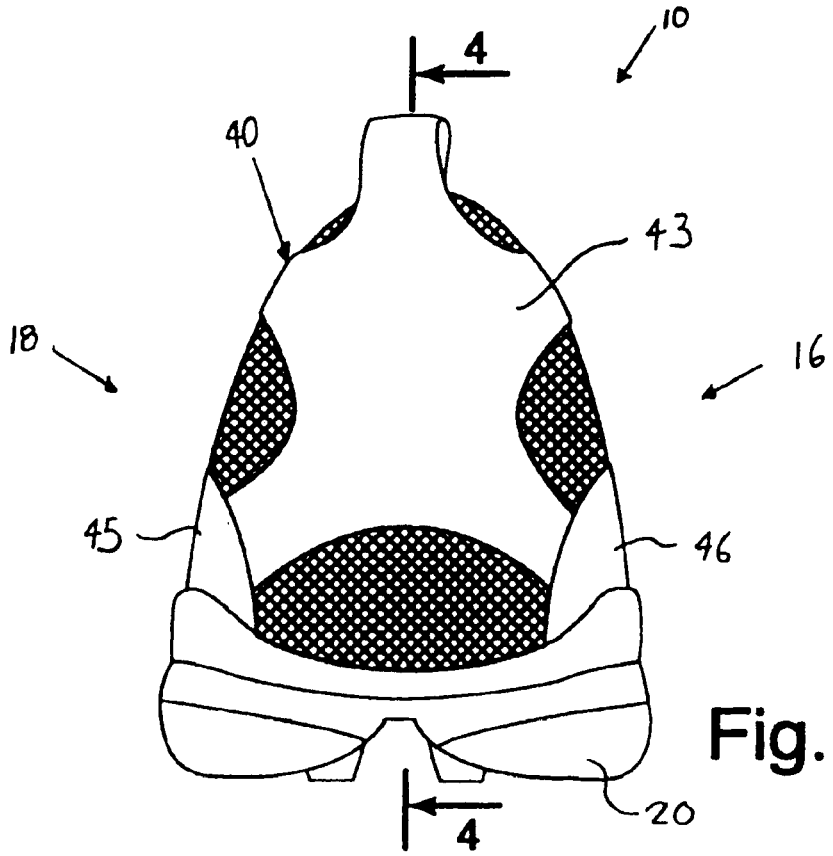
FIG. 2 is a rear view of the shoe.
Figure 3:
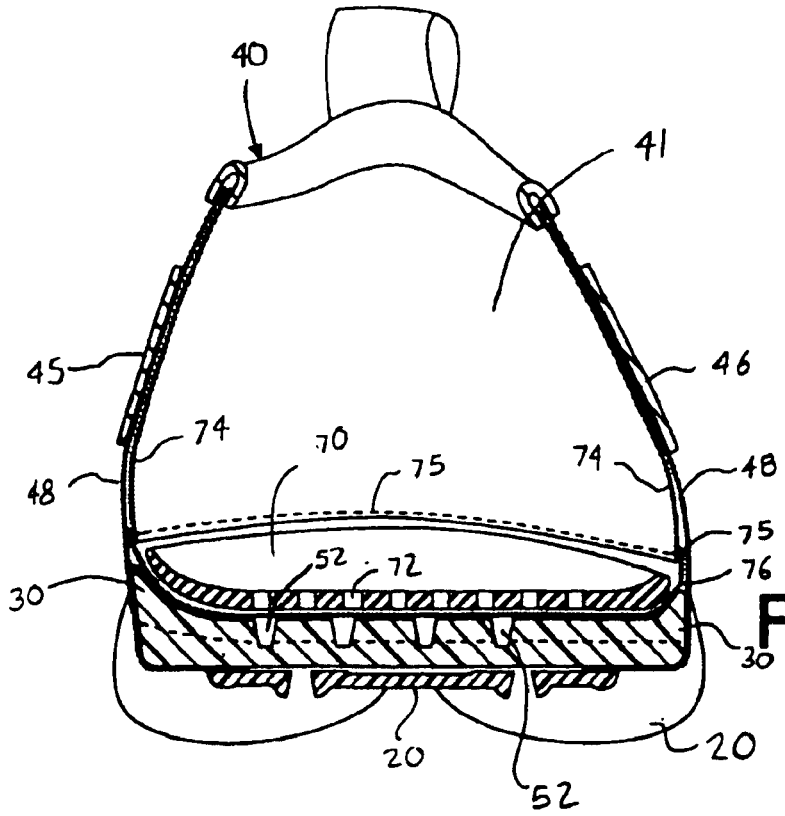
FIG. 3 is a section view along line III-III in FIG. 1.
Figure 4:
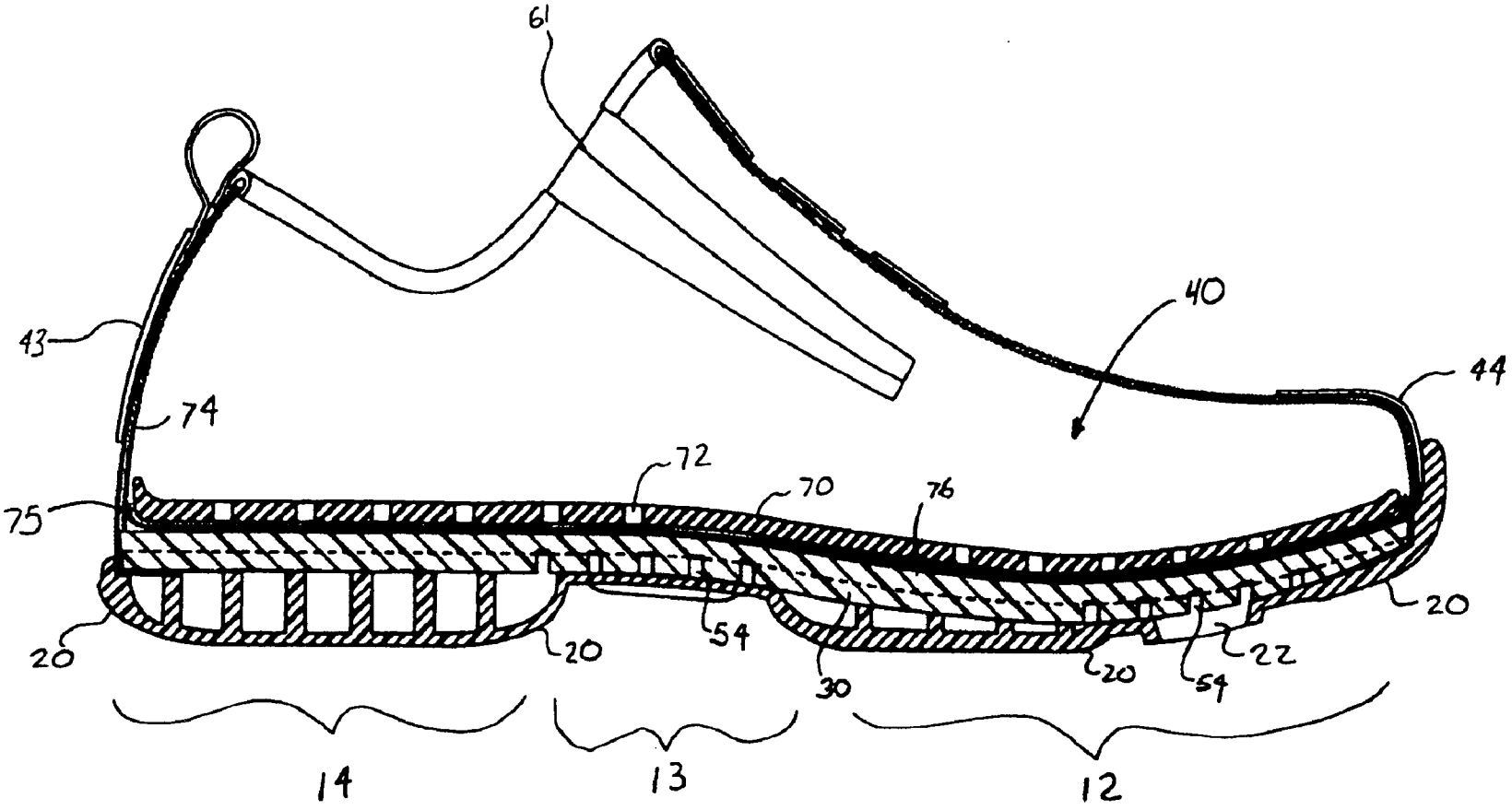
FIG. 4 is a section view along line IV-IV in FIG. 2.
Figure 5:
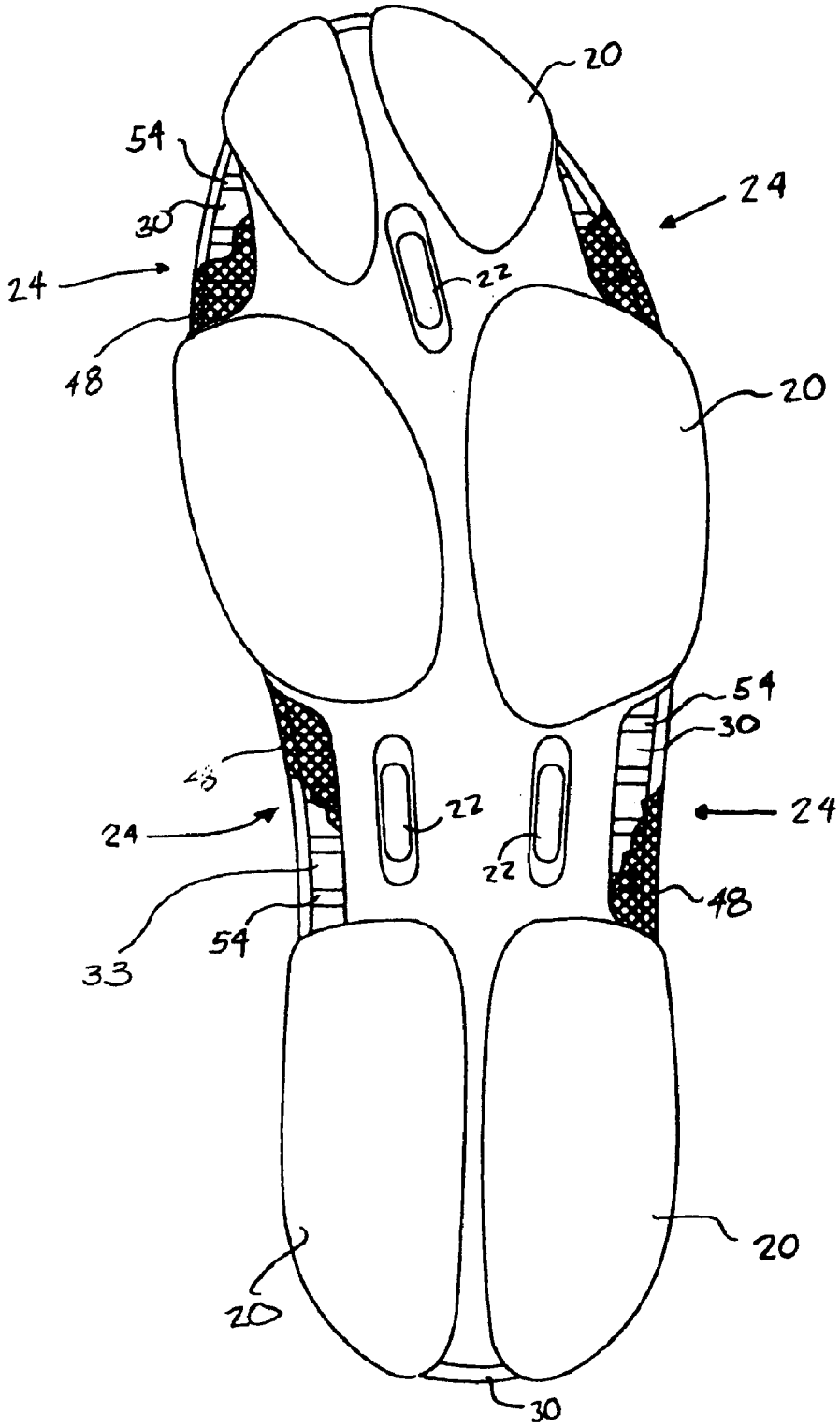
FIG. 5 is a bottom view of the shoe with the mesh broken away to the midsole and channels from which the water exits.

The reinforcing members 42 generally include a heel piece 43, a toe, piece 44, lateral members 45, medial members 46 and a plurality of tongue pieces 60, all of which provide support and structure to the shoe 10. The reinforcing members 42 are formed from conventional upper materials such as leather, canvas, synthetic materials or any other material selected to provide comfort and durability in a variety of conditions. The reinforcing members 42 pass along the outer side of the mesh 48 and are attached to the mesh with stitching 47. Other methods of attaching the mesh 48 to the reinforcing members 42 such as hot melt adhesive or cement may also be used. The reinforcing members 42, as shown in FIGS. 1 and 2, are merely exemplary and may be formed in other shapes, sizes and designs as desired for structural and aesthetic reasons.

The tongue pieces 60 provide a substantially non-elastic material to receive a lacing system 62 and a zipper 61. In the preferred embodiment, the lacing system 62 is a quick or speed lacing system allowing for fast and easy adjustment to the shoe 10. As shown in FIG. 1, the quick lacing system 62 includes an anchor 63, an eyelet 64, a lace 65 and a fastening means 66. The anchor 63 secures the lace 65 to the shoe 10. The anchor 63 is shown anchored to the medial side 16 of the shoe 10, and in the preferred embodiment, another anchor (not shown) is located approximately in a similar area on the lateral side 18. The laces 65 pass through the eyelets 64 and up through the fastening means 66, which in the preferred embodiment is a spring loaded clip through which the laces 65 slide and are locked in place allowing for swift easy adjustment of the shoe 10. It should be apparent that variations of a quick lacing system 62 may be used, such as a lacing system 62 without the laces 65 being anchored to the shoe 10. Of course, it should be readily apparent to one skilled in the art that the present invention may easily be formed using a traditional lacing system or even without a lacing system. In the preferred embodiment, the tongue pieces 60 include a zipper 61 that works in conjunction with the lacing system 62 for a quick and easy adjustment to the shoe 10. The shoe 10 incorporating the present invention may be formed without a zipper 61.

Figure 6:
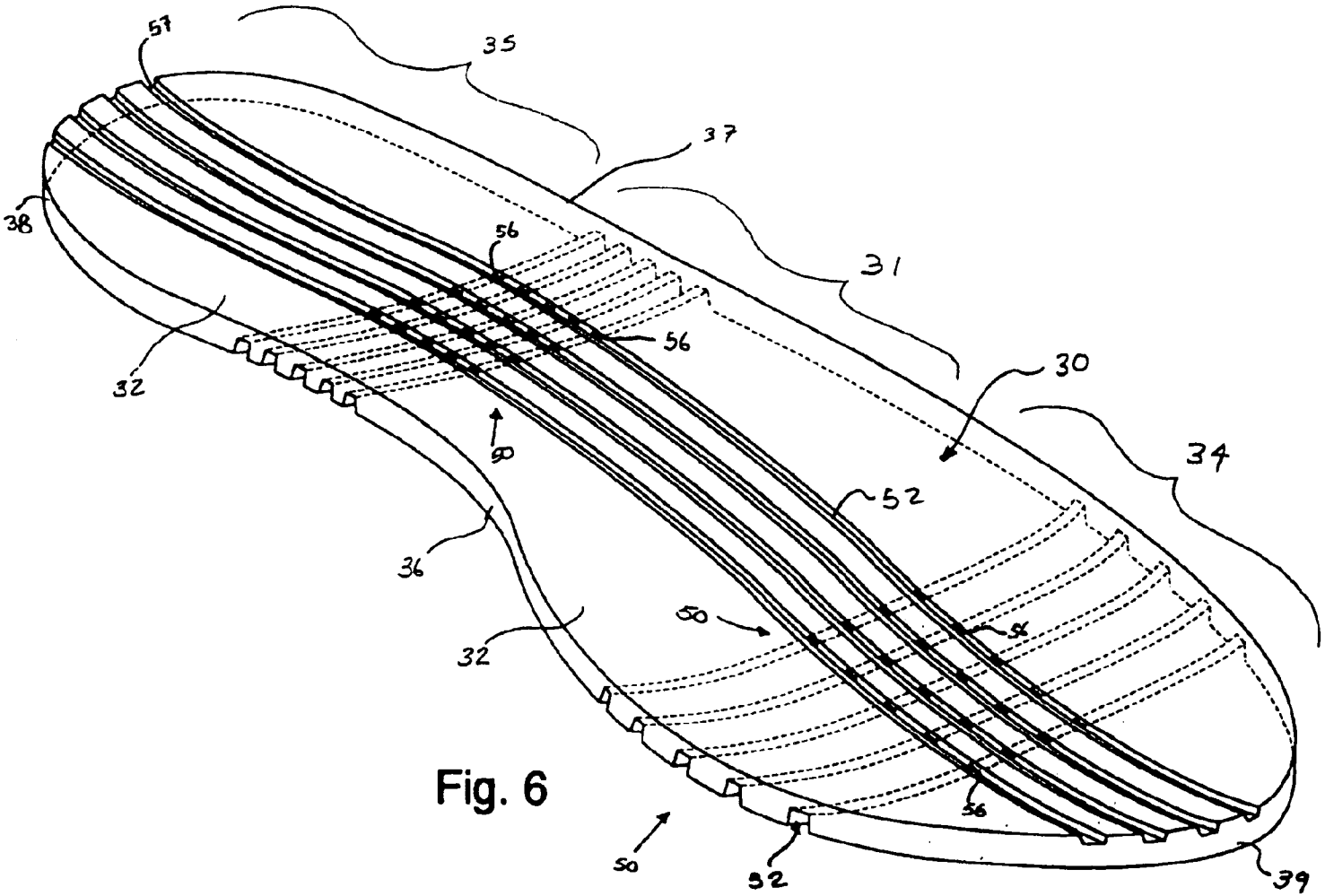
FIG. 6 is a perspective view of the midsole including channels, with broken lines to show the configuration of the bottom of the midsole.

The midsole 30 is manufactured from a relatively resilient material, selected to provide the shoe 10 with a desired level of cushioning. In the preferred embodiment, the midsole 30 is formed out of ethyl vinyl acetate (EVA). An EVA midsole 30 allows the addition of anti-bacterial agents such as MicroBan® to prevent bacterial growth. The midsole 30 includes an upper surface 32, a lower surface 33, a front portion 34, a rear portion 35, a middle portion 31, a medial edge 36 and a lateral edge 37. As shown in FIG. 6, the upper surface 32 defines a plurality of upper channels 52 while the lower surface 53 defines a plurality of lower channels 54. In the preferred embodiment, the upper channels 52 run longitudinally along the entire length of the midsole 30 from the front portion 34 to the rear portion 35. Of course, in some embodiments, the upper channels 52 may not continue along the complete length of the midsole 30, but instead be broken or stop short of the front or rear edge 38 or 39. The lower channels 54, preferably extend laterally across the midsole 30, from the medial edge 36 to the lateral edge 37 in the middle portion 31 and front portion 34. The lower channels 54 may be located anywhere on the midsole 30. Further, the upper channels 52 and lower channels 54 may be reversed in some embodiments. The number, location and size of the channels 50 may vary as needed. The channels are shown in FIG. 6 as being rectangular but other shapes such as V-grooves, half circles and ellipses may be defined by the midsole 30. In the preferred embodiment, the upper channels 52 intersect the lower channels 54 in a somewhat perpendicular pattern. Of course, the angle with which the upper channels 52 cross the lower channels 54 can widely vary. The upper channels 52 and the lower channels 54 need only cross to define openings 56 to allow water to pass from the upper channels 52 to the lower channels 54. The size and shape of the defined opening 56 may depend on the width and depth of the channels 50 as well as the angle of intersection of the channels 50. The upper channels 52 and lower channels 54 contain a depth that is great enough so that they intersect to define a plurality of openings 56. This depth will vary proportionally to the thickness of the midsole 30. Although the upper channels 52 and lower channels 54 preferably have approximately equal depth, the depth of the upper and lower channels 52 and 54 may be different, so long as the combined depth of the upper and lower channels 52 and 54 is greater than the thickness of the midsole, at least where the upper channel 52 and lower channel 54 intersect to define the openings 56.

A footbed 70 may also be inserted into the shoe 10 to provide more comfort and support to the wearer. The footbed 70 rests on top of the bottom liner 76, inside of the upper 40. The footbed 70 is perforated, defining a plurality of passages 72 to allow water to drain out of the cavity 41 defined by the upper 40. The water passes from the passages 72 through the bottom liner 76 and into the midsole 30. The size, number and placement of these passages 72 may vary from application to application. The footbed 70 is preferably formed from an EVA material that is at least slightly more resilient than the midsole 30, and may include a conventional sock liner.

The outsole 20 engages the ground and forms the wear surface of the shoe 10. The outsole 20 is generally made of a conventional outsole material that is selected to provide the desired balance between comfort, wear and traction. Although the outsole 20 is preferably a conventional rubber compound, a variety of other materials may be used to provide the desired comfort, wear and traction. The outsole 20 may include tread (not shown), lugs (not shown) and/or be otherwise configured to enhance traction. The outsole 20 defines water drainage ports 22 and cutout portions 24 that allow water to drain from the shoe 10. The shape, size, location and number of ports 22 may vary as desired. The ports 22 are located so that water may pass freely from the lower channels 56 out of the bottom of the shoe 10. The ports 22 may include a mesh covering (not shown) to prevent dirt and debris from entering the channels 50. The cutout portions 24 provide an area for the water to freely exit from the open ends of the channels 50 and 52. In the preferred embodiment, the cutout portions 24 extend not only along the side of the outsole 20 but also somewhat to the underside of the outsole 20. The cutout portions 24 are covered by the mesh 48 or the upper 40. The mesh 48 also prevents the channels from being clogged with dirt and debris in the area of the cutout portions 24. In general, the larger the cutout portion 24, the more quickly and easily the water may exit from the channels 50.

II. Manufacture and Assembly

The shoe 10 is manufactured using generally conventional machinery. The outsole 20 is manufactured by using conventional techniques and apparatuses. The outsole 20 is preferably injection or pour molded from a durable rubber using conventional molding apparatuses. The outsole 20 may be manufactured from other durable outsole materials. The tread patterns and lugs are formed in the molding operation as an integral outsole 20. In the preferred embodiment, the outlet ports 22 and cutout portions 24 are formed during the molding operation as an integral part of the outsole 20. The outlet ports 22 and/or cutout portions 24 may alternatively be formed by die cutting or other methods.

The midsole 30 is manufactured using generally conventional machinery. The midsole 30 is manufactured by using conventional techniques and apparatuses. The midsole 30 is preferably injection or pour molded from EVA, but other conventional midsole materials may be used. The channels 50 are formed during the molding operation as an integral part of the midsole 30. Alternatively, in some embodiments, the channels 50 may be added after the midsole 30 is formed, for example, by cutting.

The upper 40 is constructed of conventional materials by conventional techniques and apparatuses. The mesh 48 and reinforcing pieces 42 are cut and stitched together using conventional techniques and apparatuses. The upper 40 is manufactured using a modified Strobel construction to form a light flexible shoe 10. The top liner 74 is formed in a conventional manner as part of the upper 40. The top liner 74 is then stitched to the bottom liner so that the top liner 74 and bottom liner 76 surround the foot within the cavity 41. The mesh 48 is drawn under the midsole 30 and hot melted to the lower surface 33 of the midsole 30. Of course, other methods of attachment may be easily substituted. The outsole 20 is then cemented onto the midsole 30 using well-known cements and techniques. When the outsole 20 is cemented to the midsole 30, it overlaps the mesh 48 so that the midsole is covered by either the mesh 48 or the outsole 30. Separate screens or mesh portions (not shown) may be attached to the inner surface of the outsole 20 in place of the mesh to prevent dirt and debris from entering the channel 50 through the outlet ports 22. The mesh 48 may wrap around the midsole 30 so that the mesh 48 covers the ports 22 and prevents dirt and debris from entering the channels 50.

The footbed 70 is also manufactured by conventional techniques and apparatuses and may be inserted into the shoe 10 after it is formed. The passages 72 may be formed when the footbed 70 is molded, or more preferably die cut after the footbed 70 is molded.

If the wearer steps into water, the shoe 10 allows water to quickly drain from the shoe 10 while the shoe 10 while the shoe 10 is being worn. The water in the interior of the shoe, or cavity 41, passes through the passages 72 defined by the footbed 70, through the bottom liner 76 and into the channels 50 on the midsole 30. The bottom liner 76 functions as a filter preventing some dirt and other materials in the shoe 10 from entering the channels 50 on the midsole 30. Once the water is within the channels 50, it can exit from the shoe 10 using the upper channels 52 by draining out of the rear portion 35, or pass through the openings 56 to exit using the lower channels 54. The rear channel outlet 57 may be seen in FIG. 6. In the preferred embodiment, the toe piece 44 covers the front of the shoe 10; therefore preventing the water from exiting the front of the shoe, but in some embodiments, this toe piece could be formed to allow the water to exit. The toe piece 44 helps prevent dirt from entering the channels 50 during walking. If the water flowing through the upper channels 52 passes into the lower channels 54 through the openings 56, it may exit through the medial side 16, the lateral side 18 or the outlet ports 22. This allows the water to quickly flow to the nearest exit, thereby quickly draining the shoe. The combination of the lower channels 54 and upper channels 52 allow the shoe to drain from almost any area of the shoe 10.

The above description is that of a preferred embodiment of the invention. Various alterations and changes can be made without departing from the spirit and broader aspects of the invention as defined in the appended claims, which are to be interpreted in accordance with the principles of patent law, including the doctrine of equivalents.

What is claimed is:

1. An article of footwear, comprising:

a midsole having an upper surface and a lower surface and a thickness, said midsole defining a plurality of upper channels opening to and extending along said upper surface and a plurality of lower channels opening to and extending along said lower surface, said channels extending only partially through said thickness, said midsole further defining a plurality of openings interconnecting said upper channels and said lower channels intersecting to define a plurality of openings in a waffle type construction;

an upper attached to said midsole, said upper being manufactured from a permeable material readily permitting passage of water; and an outsole attached to said midsole to define a wear surface for the article of footwear.

2. The article of footwear of claim 1 wherein said plurality of opening are defined by intersection of said upper channels and said lower channels.

3. The article of footwear of claim 1 wherein said midsole include a peripheral edge, said upper extending downwardly over said peripheral edge.

4. The article of footwear of claim 3 wherein at least one of said upper channels and said lower channels extends to said peripheral edge of said midsole to define an open end, said upper covering said open end.

5. The article of footwear of claim 4 wherein said outsole includes a peripheral wall extending upwardly about said midsole, said peripheral wall defining recessed portions leaving said open end uncovered, whereby water is permitted to freely exit the article of footwear from said channels.

6. The article of footwear of claim 1 wherein said outsole defines outlet ports placing said midsole in fluid communication with an exterior of the article of footwear, whereby said outlet ports allow passage of water from said channels.

7. The article of footwear of claim 1 wherein at least one of said upper channels and said lower channels defines an open end in a medial side of the article of footwear.

8. The article of footwear of claim 7 wherein at least one of said upper channels and said lower channels defines an open end in a rear of the article of footwear.

9. The article of footwear of claim 7 wherein said upper channels extend longitudinally along said midsole and said lower channels extend lateral across said midsole.

10. The article of footwear of claim 5 wherein said upper further includes reinforcing members, said reinforcing members being manufactured from a substantially non-elastic material, whereby said reinforcing members provide said upper with improved strength and stability in at least select regions.

11. The article of footwear of claim 10 wherein said reinforcing members includes a heel piece reinforcing said upper in a heel region of said article of footwear.

12. The article of footwear of claim 11 wherein said reinforcing members includes a toe piece reinforcing said upper in a toe region of said article of footwear.

13. The article of footwear of claim 12 wherein said upper includes a liner disposed above said midsole, said liner being permeable to permit water to pass therethrough.

14. An article of footwear, comprising:

an upper including a permeable material permitting passage of water and a plurality of reinforcing members affixed to said permeable material;

a midsole having an upper surface, a bottom surface, a thickness and a peripheral edge, said midsole defining a plurality of upper channels opening to and extending along said upper surface and a plurality of lower channels opening to and extending along said lower surface, said channels extending only partially through said thickness, said upper channels and said lower channels intersecting to define an opening at each intersection placing said upper channels in fluid communication with said lower channels, said midsole being attached to said upper; and an outsole attached to said midsole, said outsole shaped to allow water to exit from said channels in said midsole.

15. The article of footwear of claim 14 wherein said upper extends along said peripheral edge of said midsole and is secured to said bottom surface of said midsole.

16. The article of footwear of claim 15 wherein said upper channels extend substantially longitudinally along said midsole and said lower channels extend substantially laterally across said midsole.

17. The article of footwear of claim 16 wherein at least one of said upper channels and said lower channels extends to said peripheral edge defining an open end, said permeable material covering said open end.

18. The article of footwear of claim 17 further comprising a footbed having an upper surface and a lower surface, said footbed defining passages extending from said upper surface of said footbed to said lower surface of said footbed.

19. The shoe of claim 18 wherein said upper further includes a top liner and a bottom liner, said top liner being attached to said mesh material, said bottom liner disposed above said midsole, said bottom liner being permeable and being attached to said top liner.

20. The shoe of claim 19 wherein said outsole defines outlet ports, said outlet ports allowing water to exit said shoe from said lower channels.

* * * * *